US008939872B2

(12) United States Patent
Sprague

(10) Patent No.: US 8,939,872 B2
(45) Date of Patent: Jan. 27, 2015

(54) LEG EXERCISE APPARATUS AND METHOD OF CONDUCTING PHYSICAL THERAPY USING SAME

(76) Inventor: Todd E. Sprague, Canal Winchester, OH (US)

( * ) Notice: Subject to any disclaimer, the term of this patent is extended or adjusted under 35 U.S.C. 154(b) by 494 days.

(21) Appl. No.: 13/277,370

(22) Filed: Oct. 20, 2011

(65) Prior Publication Data

US 2012/0190511 A1 Jul. 26, 2012

Related U.S. Application Data

(63) Continuation-in-part of application No. 13/014,690, filed on Jan. 26, 2011, now abandoned.

(51) Int. Cl.

| | |
|---|---|
| ***A63B 23/08*** | (2006.01) |
| ***A63B 23/10*** | (2006.01) |
| ***A47C 7/50*** | (2006.01) |
| ***A47C 16/02*** | (2006.01) |
| ***A63B 21/00*** | (2006.01) |

(Continued)

(52) U.S. Cl.

CPC ..... *A63B 21/00047* (2013.01); *A63B 23/03525* (2013.01); *A63B 23/0405* (2013.01); *A63B 2208/0204* (2013.01); *A63B 2208/0233* (2013.01)

USPC ..... 482/79; 482/80; 297/423.1; 297/423.44; 297/423.46

(58) Field of Classification Search

CPC ..... A63B 2071/0018; A63B 21/00178; A63B 2208/0233; A63B 21/1492; A63B 23/08; A63B 21/143; A63B 2023/006; A63B 21/1423; A61G 2005/128; A61G 2005/127; A61H 1/0237; A61H 1/0266; A61H 1/02; A61H 2205/10; A61H 2201/164

USPC ..... 482/79–80, 91, 142, 146, 148, 907; 108/1, 6, 8; 248/346.06, 371, 398, 447, 248/460–465; 296/75; 297/423.1, 423.39, 297/423.41, 423.44–423.46; 601/5, 23, 27, 601/34; D21/685–686

See application file for complete search history.

(56) References Cited

U.S. PATENT DOCUMENTS 826,862 A * 7/1906 Little ..... 296/75
895,632 A * 8/1908 Harris ..... 296/75

(Continued)

OTHER PUBLICATIONS

Patterson Medical—Sammons Preston—Professional Rehab Catalog 2008; Shuttle Systems & Performance Trainer—Exercise Strength (pp. 54-55) total pp. 4.

*Primary Examiner* — Loan H Thanh
*Assistant Examiner* — Joshua Lee
(74) *Attorney, Agent, or Firm* — Jason H. Foster; Kremblas & Foster

(57) ABSTRACT

A leg exercise apparatus having a supporting frame, a leg disposition assembly and a connecting panel. The supporting frame is pivotably connected to the leg disposition assembly, and an upper portion of the connecting panel is pivotably connected to the leg disposition assembly on its backside. A positioning bar passes through a lower portion of the connecting panel and is disposed in positioning grooves located on both arms of the supporting frame to secure the connecting panel. An end opening is located at an end of the supporting frame and connects to two tunnel grooves at both arms so the positioning bar can be pushed out through the tunnel grooves and end opening, which leads the leg disposition assembly to collapse into the supporting frame to form a compact and portable leg exercise apparatus.

11 Claims, 10 Drawing Sheets

(51) Int. Cl.
*A63B 23/035* (2006.01)
*A63B 23/04* (2006.01)

(56) References Cited

U.S. PATENT DOCUMENTS

| | | | | | |
|---|---|---|---|---|---|
| 1,452,915 | A | * | 4/1923 | Kennedy | 5/648 |
| 1,619,685 | A | * | 3/1927 | Updegrove et al. | 5/648 |
| 1,985,807 | A | | 12/1934 | Steigerwald et al. | |
| 1,990,497 | A | * | 2/1935 | Niday | 482/19 |
| 2,281,119 | A | | 4/1942 | Smith | |
| 2,566,498 | A | | 9/1951 | Revercomb | |
| 3,189,346 | A | * | 6/1965 | Miguez | 482/81 |
| 3,297,320 | A | * | 1/1967 | Di Benedetto | 482/148 |
| 3,401,931 | A | * | 9/1968 | McCafferty et al. | 482/19 |
| 3,746,335 | A | * | 7/1973 | Fichter et al. | 482/19 |
| 4,114,610 | A | | 9/1978 | Koch | |
| 4,286,782 | A | | 9/1981 | Fuhrhop | |
| 4,441,758 | A | | 4/1984 | Fleischer | |
| 4,453,768 | A | | 6/1984 | Cranford, Jr. et al. | |
| 4,527,797 | A | | 7/1985 | Slade, Jr. et al. | |
| 4,561,649 | A | * | 12/1985 | Forsythe | 482/80 |
| 4,611,803 | A | * | 9/1986 | Newton, Jr. | 482/19 |
| 4,693,470 | A | * | 9/1987 | Ogawa | 482/79 |
| 4,754,965 | A | * | 7/1988 | Moye | 482/19 |
| 4,848,243 | A | * | 7/1989 | Giordano | 108/9 |
| 4,852,874 | A | | 8/1989 | Sleichter, III et al. | |
| 4,907,798 | A | | 3/1990 | Burchatz | |
| 4,912,796 | A | | 4/1990 | Crump | |
| 5,035,393 | A | * | 7/1991 | Menaged | 248/456 |
| 5,087,036 | A | * | 2/1992 | Cooper | 482/79 |
| 5,125,650 | A | * | 6/1992 | Paris | 482/142 |
| 5,336,149 | A | | 8/1994 | Wang | |
| 5,340,139 | A | | 8/1994 | Davis | |
| 5,348,377 | A | * | 9/1994 | Grosch | 297/423.45 |
| 5,438,720 | A | * | 8/1995 | Daneshvar | 5/505.1 |
| 5,499,958 | A | * | 3/1996 | Hess | 482/79 |
| 5,556,120 | A | | 9/1996 | Davis | |
| 5,577,806 | A | | 11/1996 | Ugalde | |
| 5,584,535 | A | * | 12/1996 | Jacobson et al. | 297/423.46 |
| 5,607,135 | A | * | 3/1997 | Yamada | 248/456 |
| 5,645,516 | A | * | 7/1997 | Foster | 482/79 |
| 5,656,003 | A | | 8/1997 | Robinson et al. | |
| 5,807,211 | A | | 9/1998 | Berryhill | |
| 5,875,869 | A | | 3/1999 | Busuttil et al. | |
| 5,890,559 | A | | 4/1999 | Busuttil et al. | |
| 5,954,621 | A | | 9/1999 | Joutras et al. | |
| 6,042,523 | A | * | 3/2000 | Graham | 482/121 |
| 6,293,591 | B1 | * | 9/2001 | Pecci | 281/33 |
| 6,334,624 | B1 | | 1/2002 | Giglio | |
| D473,272 | S | * | 4/2003 | Heins | D21/685 |
| 6,659,924 | B1 | * | 12/2003 | Hsu | 482/146 |
| 6,679,468 | B1 | * | 1/2004 | Hsu | 248/454 |
| 6,745,869 | B2 | * | 6/2004 | Garrett | 182/45 |
| 6,758,825 | B1 | * | 7/2004 | Mathew | 601/5 |
| 6,935,992 | B2 | | 8/2005 | Gehrke | |
| 7,070,540 | B1 | * | 7/2006 | Priester | 482/14 |
| 7,070,545 | B2 | | 7/2006 | Lull et al. | |
| 7,108,641 | B2 | | 9/2006 | Pertegaz-Esteban | |
| 7,115,080 | B2 | | 10/2006 | Cockrill, Jr. et al. | |
| 7,179,209 | B2 | | 2/2007 | Sechrest et al. | |
| 7,354,110 | B1 | | 4/2008 | Raghubir | |
| 7,503,882 | B2 | | 3/2009 | Sechrest et al. | |
| 7,563,209 | B2 | | 7/2009 | Webber et al. | |
| 7,608,022 | B2 | | 10/2009 | Lull et al. | |
| 7,608,024 | B2 | | 10/2009 | Sechrest et al. | |
| 7,608,028 | B2 | | 10/2009 | Pertegaz-Esteban | |
| 7,654,938 | B2 | | 2/2010 | Webber et al. | |
| 7,708,348 | B2 | | 5/2010 | Barr | |
| 7,727,125 | B2 | | 6/2010 | Day | |
| 7,731,638 | B2 | | 6/2010 | Webber et al. | |
| 8,205,561 | B1 | * | 6/2012 | Bierworth | 108/9 |
| 8,267,477 | B1 | * | 9/2012 | Appiah Finn | 297/423.41 |
| 8,485,952 | B2 | * | 7/2013 | Gehrke | 482/130 |
| 2003/0047979 | A1 | | 3/2003 | Carom | |
| 2004/0082438 | A1 | | 4/2004 | Lastayo et al. | |
| 2004/0204293 | A1 | | 10/2004 | Andreasen | |
| 2006/0103219 | A1 | | 5/2006 | Sardana | |
| 2007/0037671 | A1 | | 2/2007 | Murphy | |
| 2008/0108917 | A1 | | 5/2008 | Joutras et al. | |
| 2008/0108918 | A1 | | 5/2008 | Joutras et al. | |
| 2009/0170672 | A1 | | 7/2009 | McMullen | |
| 2010/0041531 | A1 | | 2/2010 | Rochford | |
| 2010/0164201 | A1 | | 7/2010 | Hochberg et al. | |

* cited by examiner

LEG EXERCISE APPARATUS AND METHOD OF CONDUCTING PHYSICAL THERAPY USING SAME

BACKGROUND OF THE INVENTION

The present invention relates generally to an exercise apparatus, and more particularly to a leg exercise apparatus and a method of conducting physical therapy for patients who are in wheelchairs with at least minimal active motion in the lower extremities.

The population in America is becoming older and heavier. The percentage of geriatric people (and therefore patients) is rising as the baby boom generation is reaching their mid-60's. Also, studies confirm that the percentage of obese people is rising in every age group. The shift toward older and heavier is even more evident in the patient population receiving medical treatment from physical therapists as this population tends to have more health problems and needs more frequent and longer stays at hospitals and skilled nursing facilities.

An elementary component to initiate improved muscle tone (whether normalizing hypotonic post stroke muscle or increasing myofiber firing and hypertrophy in a deconditioned muscle) is getting that muscle into a weight-bearing environment. Because of the foregoing reasons, however, it is difficult or dangerous to the patient, medical staff or family to try to stand the patient. In hospitals and nursing homes today many people who are too weak to support their own weight in standing are lifted by mechanical means (for example using a Hoyer lift) from a bed into a wheelchair, where they stay until lifted back to bed. The problem with this is that the patient receives no time with weight-bearing muscle use through the day because of excessive weight, paralysis limitations from neurological conditions, or deconditioning from cardio-pulmonary issues, orthopedic procedures or other general debility problems. These people would greatly benefit from leg exercise. However, moving them onto a traditional leg press machine is nearly impossible. Thus, their recovery is slow or halted due to an inability to initiate basic weight bearing and muscle rebuilding.

Preventing prolonged recovery due to the foregoing problems would therefore be advantageous. Doing so would mean less time spent in hospital and skilled nursing facilities as well as less financial burden on insurers (including Medicare, Medicaid and private insurers), the government, and society in general. Therefore, there is a need for a new and improved leg exercise apparatus that allows patients to perform weight-bearing exercises while they are sitting in the wheelchair.

BRIEF SUMMARY OF THE INVENTION

It is an object of the present invention to provide a leg exercise apparatus and a method of conducting physical therapy that can speed up the recovery time of geriatric and bariatric populations by allowing weight-bearing exercise under the direction of a physical therapist while the patient is sitting in a wheelchair.

It is another object of the present invention to provide a relatively small and portable leg exercise apparatus for patients who are in medical isolation (unable to leave their room for infection control issues or lowered immune systems) to exercise in their rooms with a therapist who directs the use of the apparatus and then quickly disinfects it for the next use.

It is a further object of the present invention to provide a leg exercise apparatus for patients sitting in wheelchairs, in which the leg exercise apparatus incorporates resistance training to build strength in muscles of the lower extremity, including quadriceps, gastrocnemius, soleus, gluteus maximus, gluteus medius, piriformis, etc. that are the primary movers and secondary stabilizer support for leg extensions. Leg extension is actually the primary motion for the "sit-to-stand" transfer movement and a major obstacle for the weakened and temporarily wheelchair-dependent patients.

It is still a further object of the present invention to provide a leg exercise method and apparatus that can be used to build strength and allow the patient to advance from sit-to-stand movement independence to standing independence, and finally to gait locomotion. Also, the leg exercise apparatus is used to help the patient decrease reliance on wheelchairs or other assistive devices, to improve quality of life, regain prior level of function, and return to normal activities of daily living in the home and community, with an additional advantage of decreased need for time in a skilled nursing setting by speeding recovery.

In one aspect, the present invention includes a leg exercise apparatus having (a) a supporting frame with a receiving space defined by a base, an end portion, and first and second arms that are parallel and extended from both sides of the end portion, wherein a plurality of positioning grooves are located at an inner surface of each first and second arms; (b) a leg disposition assembly having a foot platform and a heel rest at a front surface thereof, and pivotably connected to the supporting frame; and (c) a connecting panel, an upper portion of which is pivotably connected to the backside of the leg disposition assembly, wherein a positioning bar passes through a lower portion of the connecting panel, and is disposed in the positioning grooves of the first and second arms to secure the connecting panel and the leg disposition assembly, and further determine an angle of the foot platform of the leg disposition assembly.

In one embodiment, a connecting portion is extended from a lower portion of the leg disposition assembly to pivotably connect with the first and second arms of the supporting frame. In an exemplary embodiment, a pair of tunnel grooves that are located immediately next to the end portion are formed at an inner surface of each first and second arms, and the tunnel grooves are connected to an edge opening underneath the end portion, so when the positioning bar is disposed in the tunnel grooves, the user can push the positioning bar out of the supporting frame through the tunnel grooves and the edge opening, and the leg disposition assembly collapses into the receiving space. In a further embodiment, a panel opening is formed at the lower portion of the connecting panel, so the user can put his hand into the panel opening, hold a portion of the positioning bar and carry the leg exercise apparatus.

In another aspect, the present invention provides a method of conducting physical therapy comprising steps of: (a) providing a leg exercise apparatus described above; (b) placing the leg exercise apparatus on a floor and the end portion thereof against a wall surface; (c) a physical therapist, standing behind a wheelchair, while a patient sits in the wheelchair with the feet placed on the foot platform of the leg disposition assembly; (d) the physical therapist exerts force to push the wheelchair toward the wall surface to press muscles of the patient's lower extremity for a predetermined period of time; (e) the patient exerts a counterforce against the physical therapist until the muscles of the patient's lower extremity restore to their original position; and (f) repeating steps (d) and (e) for a predetermined number of times.

In one embodiment, the method of conducting physical therapy further comprises a step of the therapist adjusting the angle of the foot platform of the leg disposition assembly by engaging the positioning bar in different positioning grooves located at the inner surface of each first and second arms. In another embodiment, the method of conducting physical therapy further comprises a step of the physical therapist cleaning the leg exercise apparatus after use, and carrying it to a next patient. In a further embodiment, the method of conducting physical therapy further comprises a step (i) of forming an offset at a lower portion of the end portion to reduce a contact area between the end portion and the wall surface to avoid damage to the wall surface when exerting forces.

Figure 1:
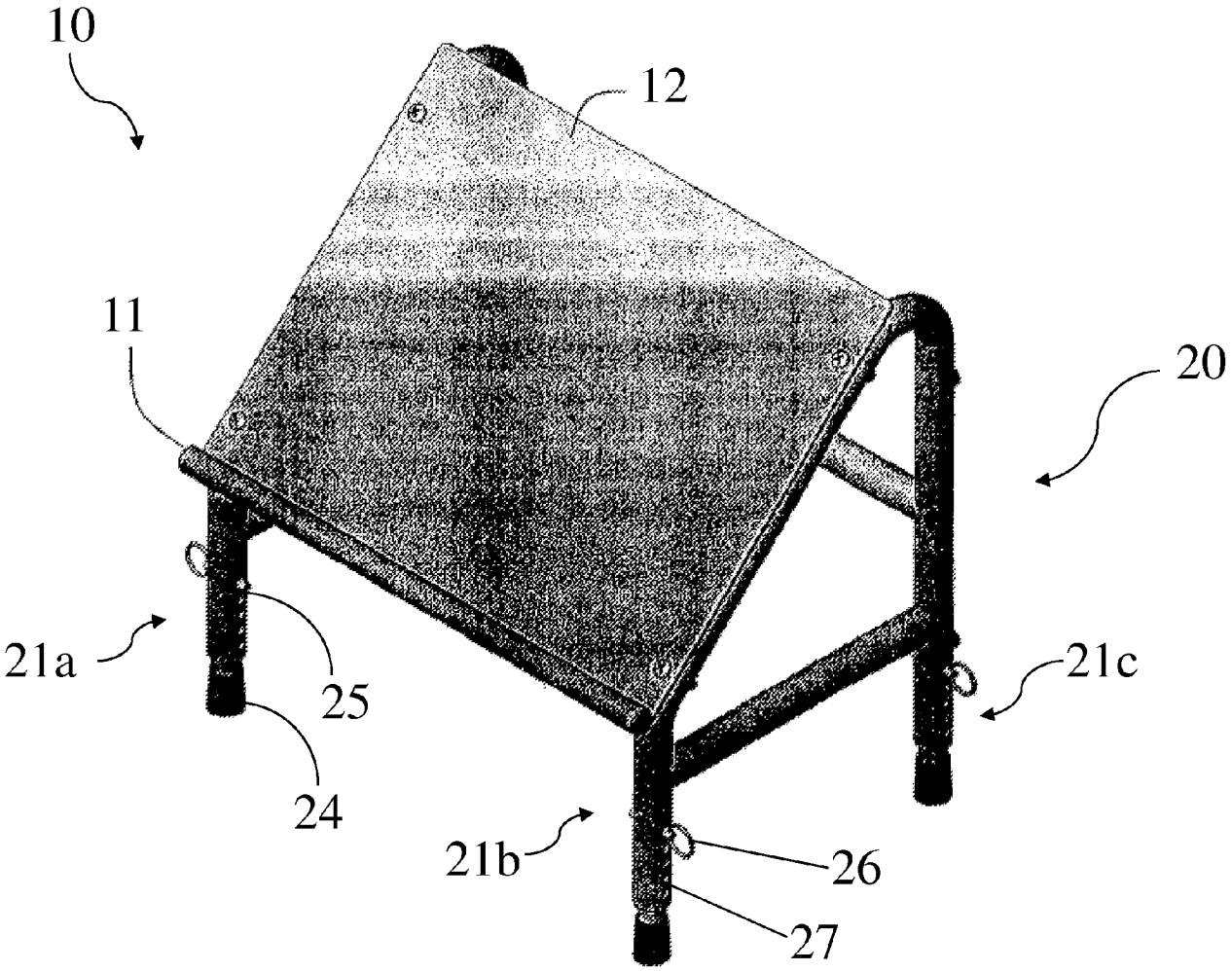
FIG. 1 is a view in perspective illustrating one embodiment of a leg exercise apparatus in the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. patent application Ser. No. 13/014,690, which is the above-claimed priority application, is incorporated herein by reference.

According to one aspect of the present invention shown in FIG. 1, a leg press assembly 10 includes a heel rest 11, a foot platform 12 operatively connected with heel rest 11, and a support structure 20 for the heel rest 11 and foot platform 12. When in use, the leg press assembly 10 is positioned against a wall and a patient sits in a conventional wheelchair with feet placed on the foot platform 12. A therapist exerts force towards the wall while the patient exerts a counterforce with his or her legs. In one embodiment, the support structure 20 has four legs 21*a*, 21*b*, 21*c* and 21*d* (not visible) that make the leg press assembly 10 selectively adjustable to varying vertical heights. Each leg has a first complimentary shaft component 24 and a second complimentary socket component 25 that are slidingly adjustable with respect to each other and locked in place with a pin 26 through a corresponding hole 27. The foot platform 12 is preferably at an angle of about 55 degrees from the horizon when placed on a level surface as shown in FIG. 1, although this angle can vary significantly as will be appreciated from the disclosure herein.

Figure 2A:
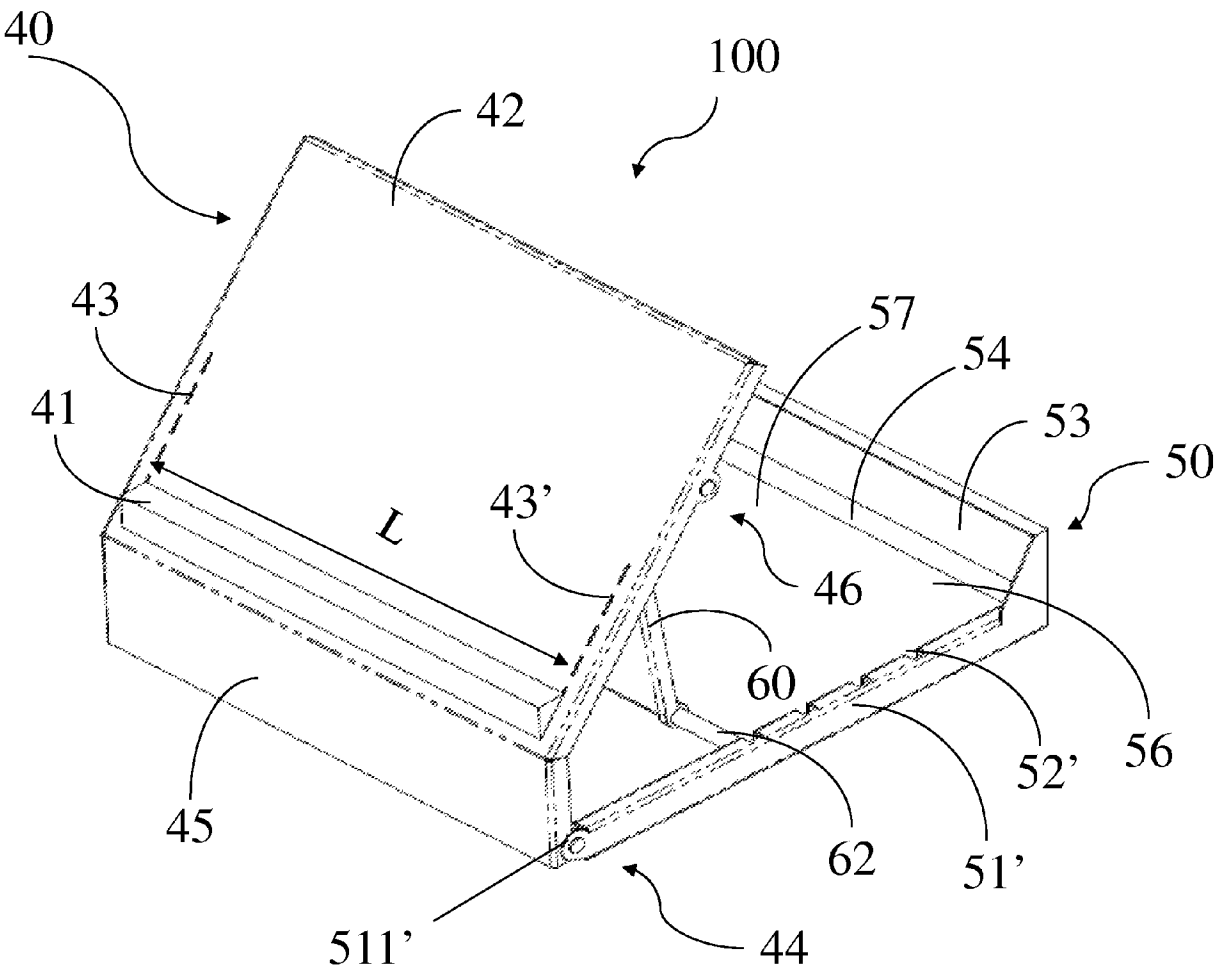
FIGS. 2A and 2B are front views in perspective illustrating another embodiment of a leg exercise apparatus in the present invention.
Figure 2B:
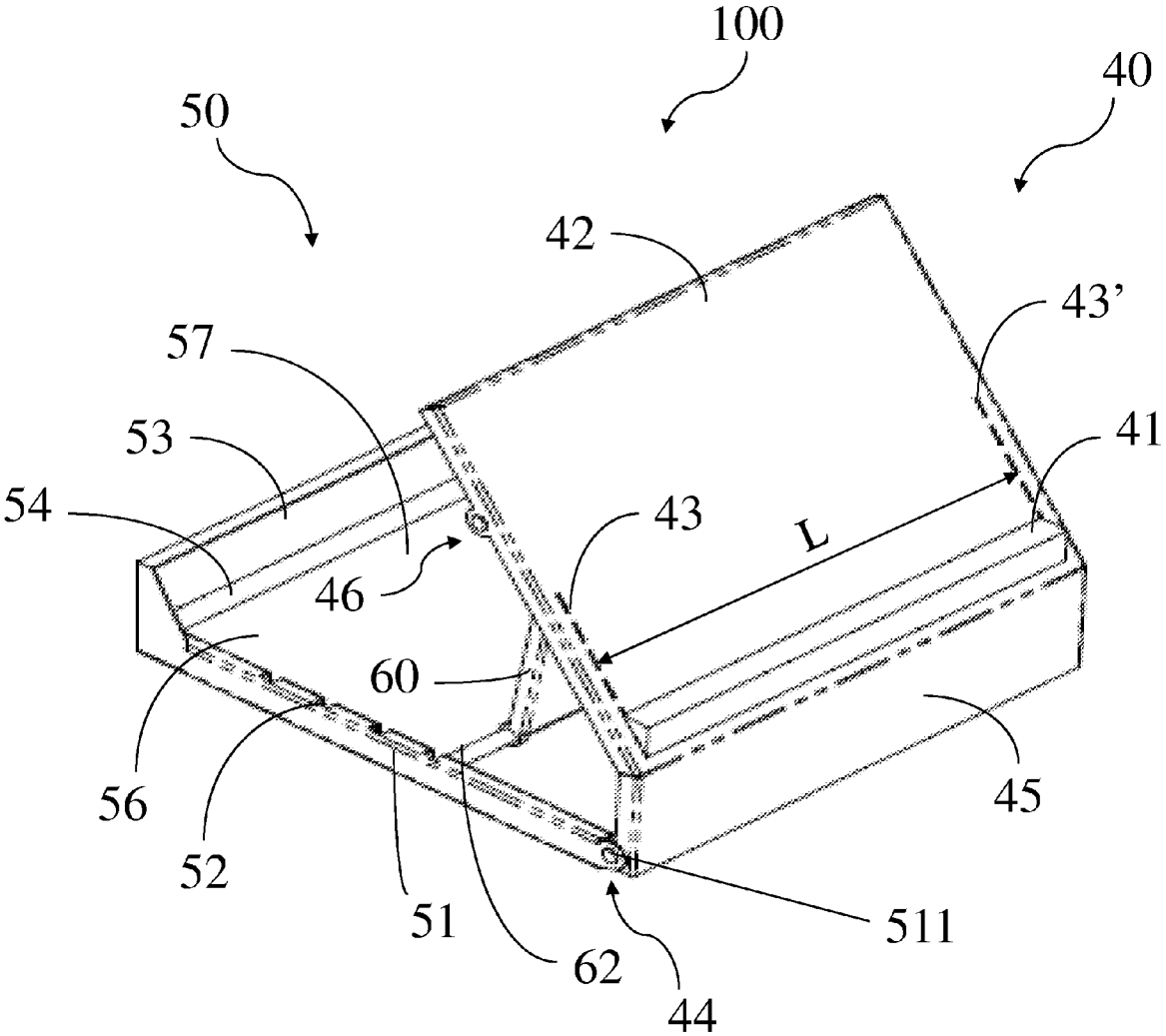

According to another embodiment of the present invention shown in FIGS. 2A and 2B, an exercise apparatus 100 includes a leg disposition assembly 40, a supporting frame 50 and a connecting panel 60. The leg disposition assembly 40 may include a heel rest 41, a foot platform 42, and a plurality of slots 43 located at one side of the foot platform 42 and their corresponding slots 43' located at the other side thereof. The slots 43 and their corresponding slots 43' are used to engage with a pair of hooks (not shown) located at the backside of the heel rest 41. The hooks extend into and secure the heel rest 41, and allow one to adjust the heel rest's position according to the size of a patient's feet by removal and re-insertion at a different location. The distance between each slot 43 and its corresponding slot 43' is substantially equal to the length (L) of the heel rest 41.

Figure 3A:
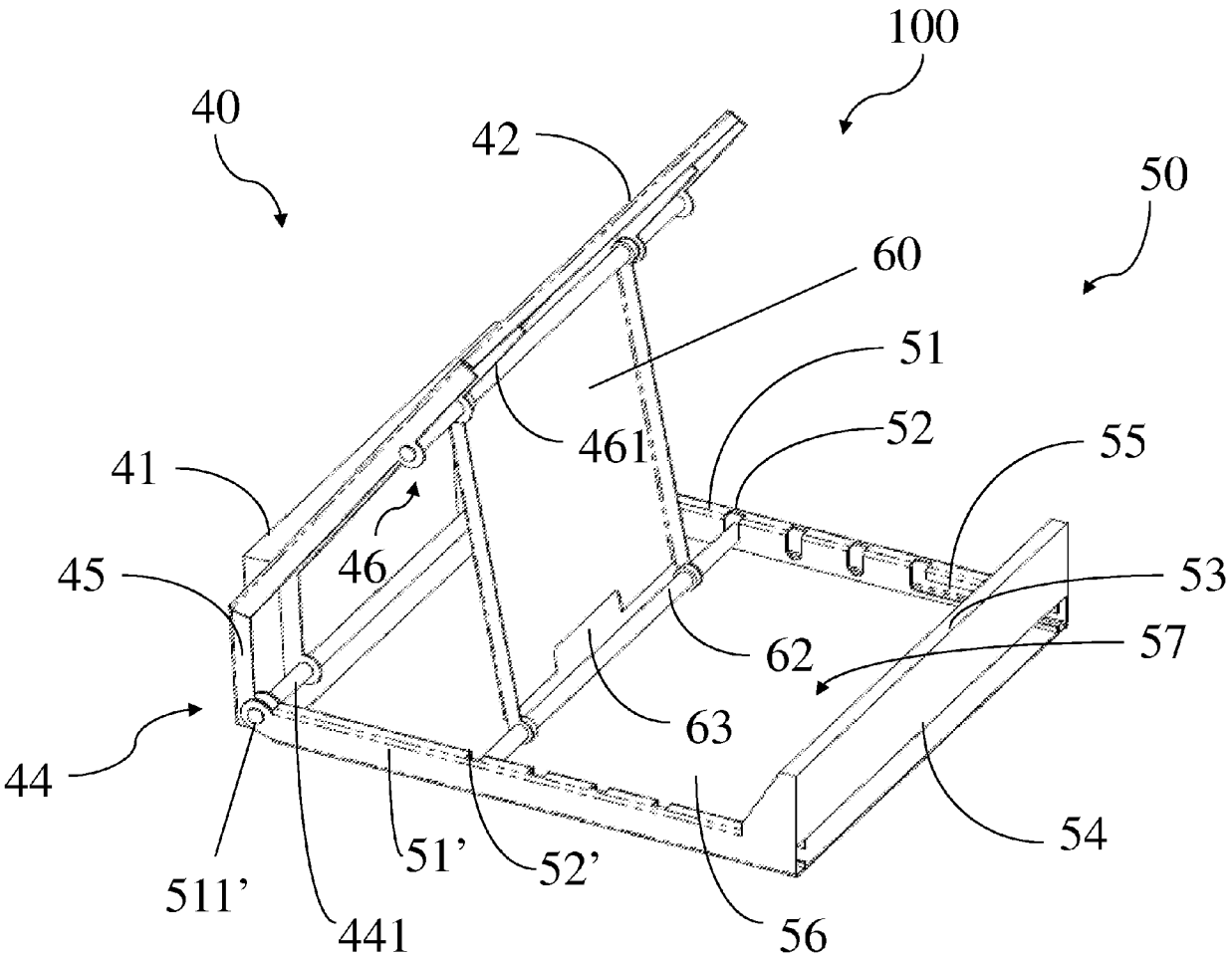
FIGS. 3A and 3B are rear views in perspective illustrating the embodiment in FIGS. 2A and 2B in the present invention.
Figure 3B:
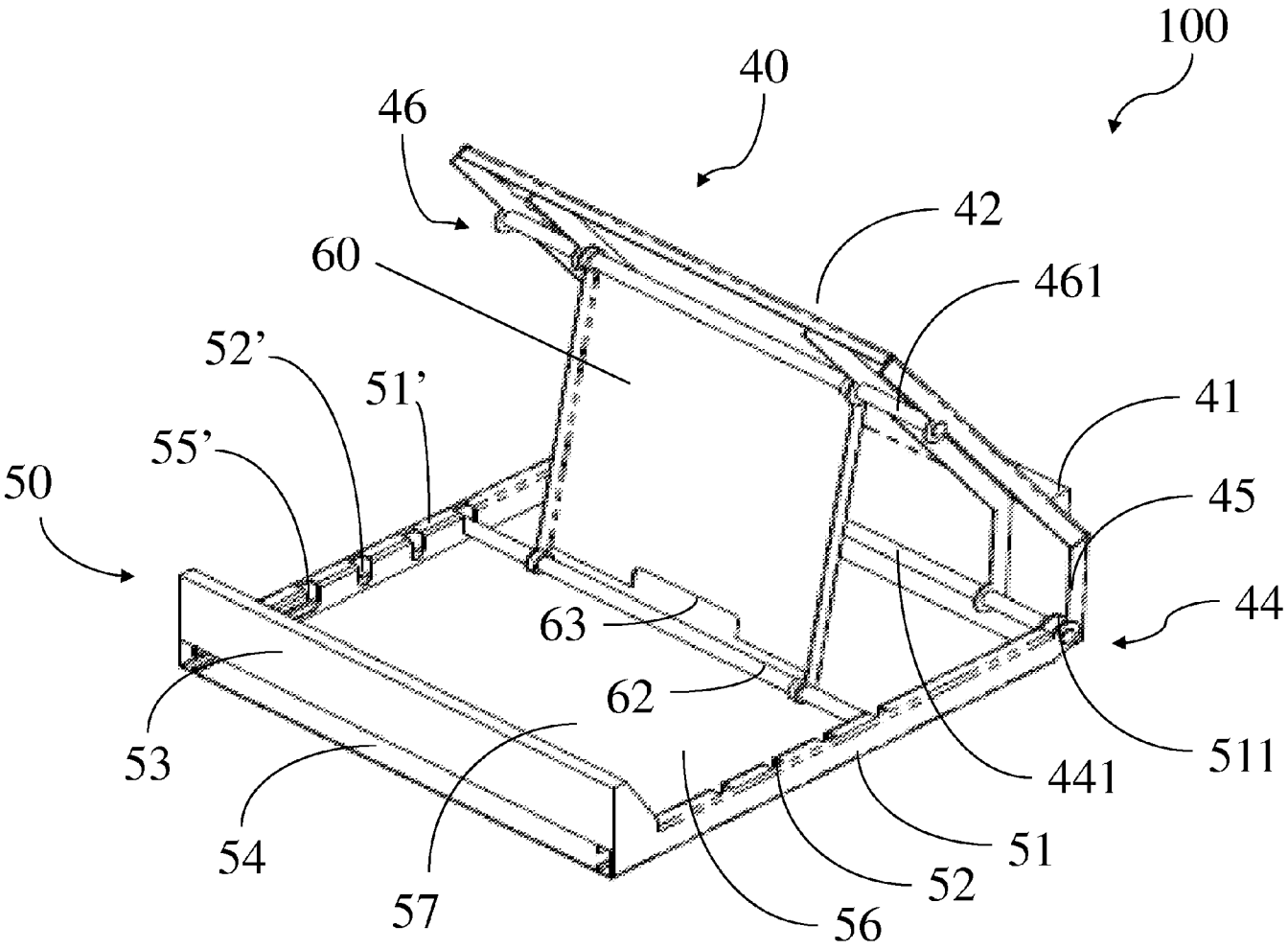

The supporting frame 50 has an end portion 53, first and second arms 51 and 51' that are substantially parallel to each other and extend substantially perpendicularly from the end portion 53, a base 56 and a receiving space 57. As shown in FIGS. 3A and 3B, the foot platform 42 is pivotably connected to the supporting frame 50 through a connecting portion 45 that extends from a lower edge of the foot platform 42 and pivotably connects to the supporting frame 50 through a lower hinge 44. More particularly, the lower hinge 44 has a lower hinge rod 441 passing through a first connecting hole 511 formed in the first arm 51 of the supporting frame 50, first and second holes (not shown) found in tabs extending from the connecting portion 45, and a connecting hole 511' of the second arm 51' of the supporting frame 50 to pivotably connect the foot platform 42 and the supporting frame 50.

The leg disposition assembly 40 has an upper hinge 46 on the backside of the foot platform 42. The upper hinge 46 has an upper hinge rod 461 passing through upper panel connecting holes formed through tabs extending from the foot platform 42 and tabs located on an upper portion of the connecting panel 60. This pivotably connects and secures the upper portion of the connecting panel 60 to the backside of the foot platform 42. The connecting panel 60 is preferably smaller than the foot platform 42 and is preferably located around the center of the backside of the foot platform 42. The connecting panel 60 extends from the upper hinge rod 461 to a positioning bar 62 that connects with the connecting panel 60 through the lower panel.

A plurality of positioning grooves are formed at an inner portion of the first arm 51, and the corresponding positioning grooves are located at a corresponding portion of the second arm 51'. One end of the positioning bar 62 is disposed at the groove 52 when the opposite end is disposed at the corresponding groove 52' to secure the connecting panel 60 to the supporting frame 50. The position of the positioning bar 62 determines an angle of the foot platform 42 as will become apparent from the disclosure herein. Because the connecting panel 60 is pivotably connected at the backside of the foot platform 42 and the foot platform 42 is also pivotably connected to the supporting frame 50, a movement of the positioning bar 62 from one pair of positioning grooves to another moves the connecting panel 60 and thereby simultaneously moves the foot platform 42 relative to the supporting frame 50. As stated in the previous embodiment, the foot platform 42 is preferably at the angle of about 55 degrees and this occurs when the positioning bar 62 is in the positioning grooves 52 and 52'. However, the foot platform 42 can be adjusted from this angle by disposing the positioning bar 62 at different positioning grooves. For example, the angle of the foot platform 42 decreases as the positioning bar 62 is moved toward the end portion 53 of the supporting frame 50, and increases as it is moved away from the end portion 53.

Figure 4B:
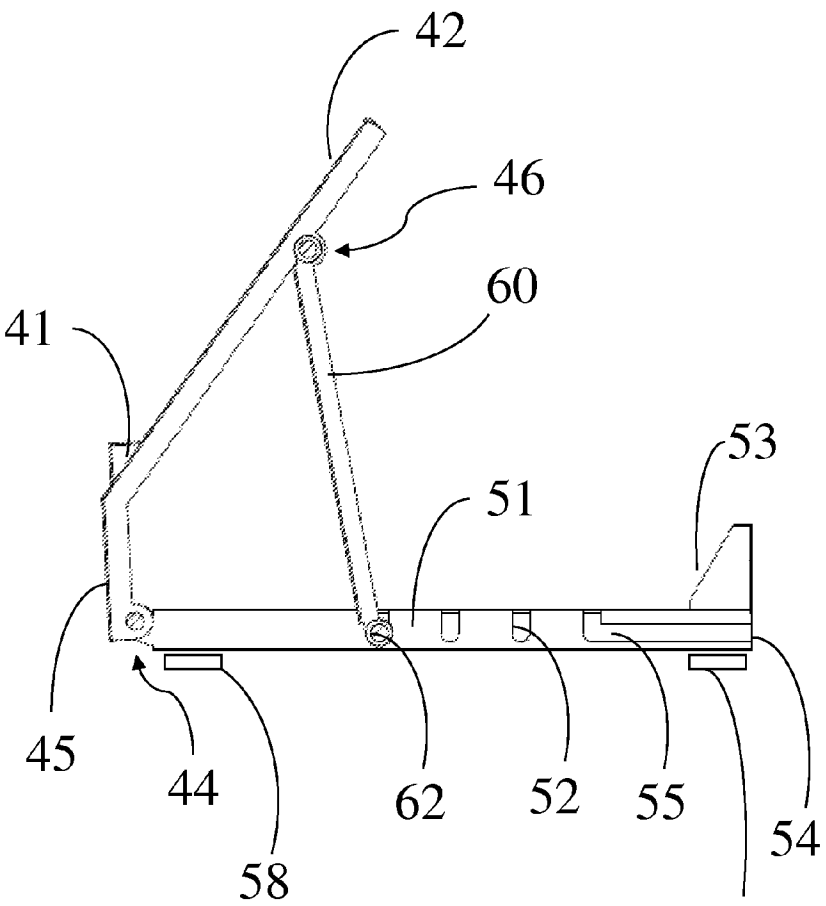
FIG. 4B is a side view in section illustrating the embodiment of FIG. 4A through the line A-A.
Figure 4A:
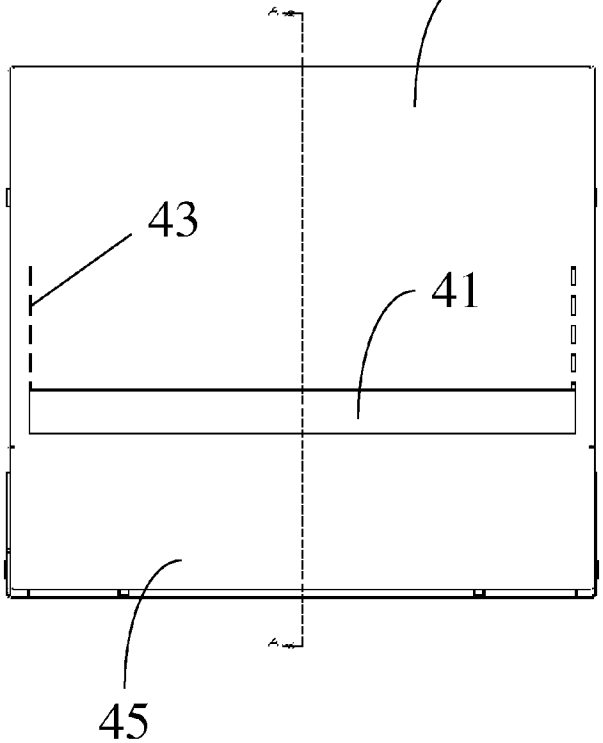
FIG. 4A is a front view illustrating the embodiment of FIGS. 2A and 2B.

As illustrated in FIGS. 3A and 3B, the tunnel grooves 55 and 55' are formed adjacent the end portion 53 at the inner portions of the first arm 51 and the second arm 51', respectively. As shown in a sectional view (from line A-A of FIG. 4A) in FIG. 4B, the tunnel grooves 55 and 55'are connected with an edge opening 54 underneath the end portion 53. Therefore, when the positioning bar 62 is disposed in the tunnel grooves 55 and 55', the positioning bar 62 can be slidingly pushed out from the supporting frame 50 through the tunnel grooves 55 and 55' and the edge opening 54, and virtually the entire structure of the leg disposition assembly 40 collapses into the receiving space 57 of the supporting frame 50 as shown in FIG. 5.

Figure 5:
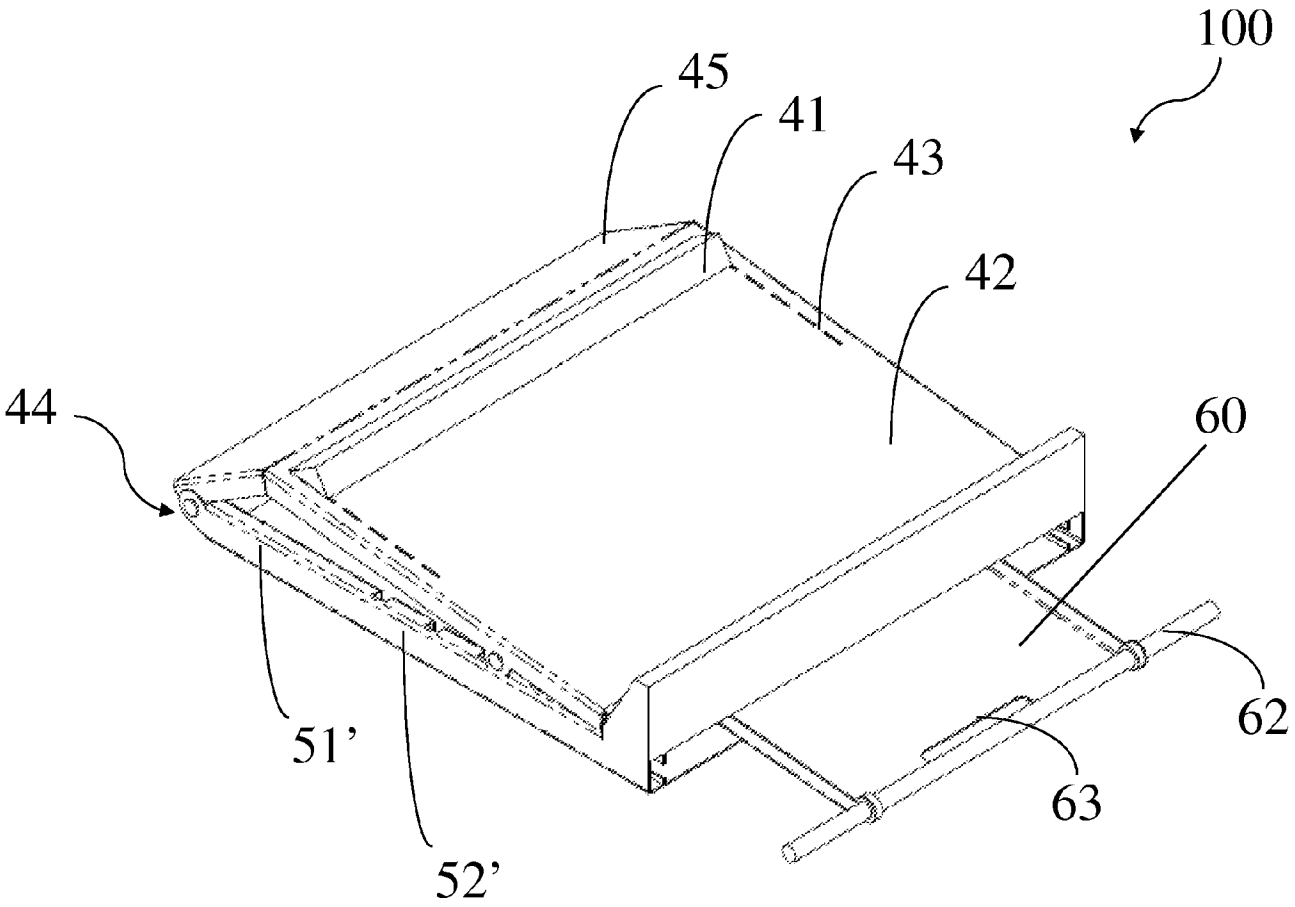
FIG. 5 is a view in perspective illustrating the leg disposition assembly collapsed to form a compact and portable leg exercise apparatus.

Furthermore, as best seen in FIGS. 3A, 3B and 5, a panel opening 63 is formed at the center of the lower portion of the connecting panel 60 close to the positioning bar 62. When the positioning bar 62 is slidingly pushed out from the supporting frame 50 during the collapse of the leg disposition assembly 40 into the receiving space 57 (shown in FIG. 5), the exercise apparatus 100 becomes much more compact and the user can simply extend a hand through the panel opening 63, grasp a portion of the positioning bar 62 and carry the leg exercise apparatus 100 in the manner of a suitcase.

It is noted that the leg exercise apparatus can be made of various materials such as metal, wood, composite material, or the like. The apparatus 100 is made of sheet steel, but the weight of the leg exercise apparatus 100 can be significantly reduced if it is made of composite materials.

Figure 6:
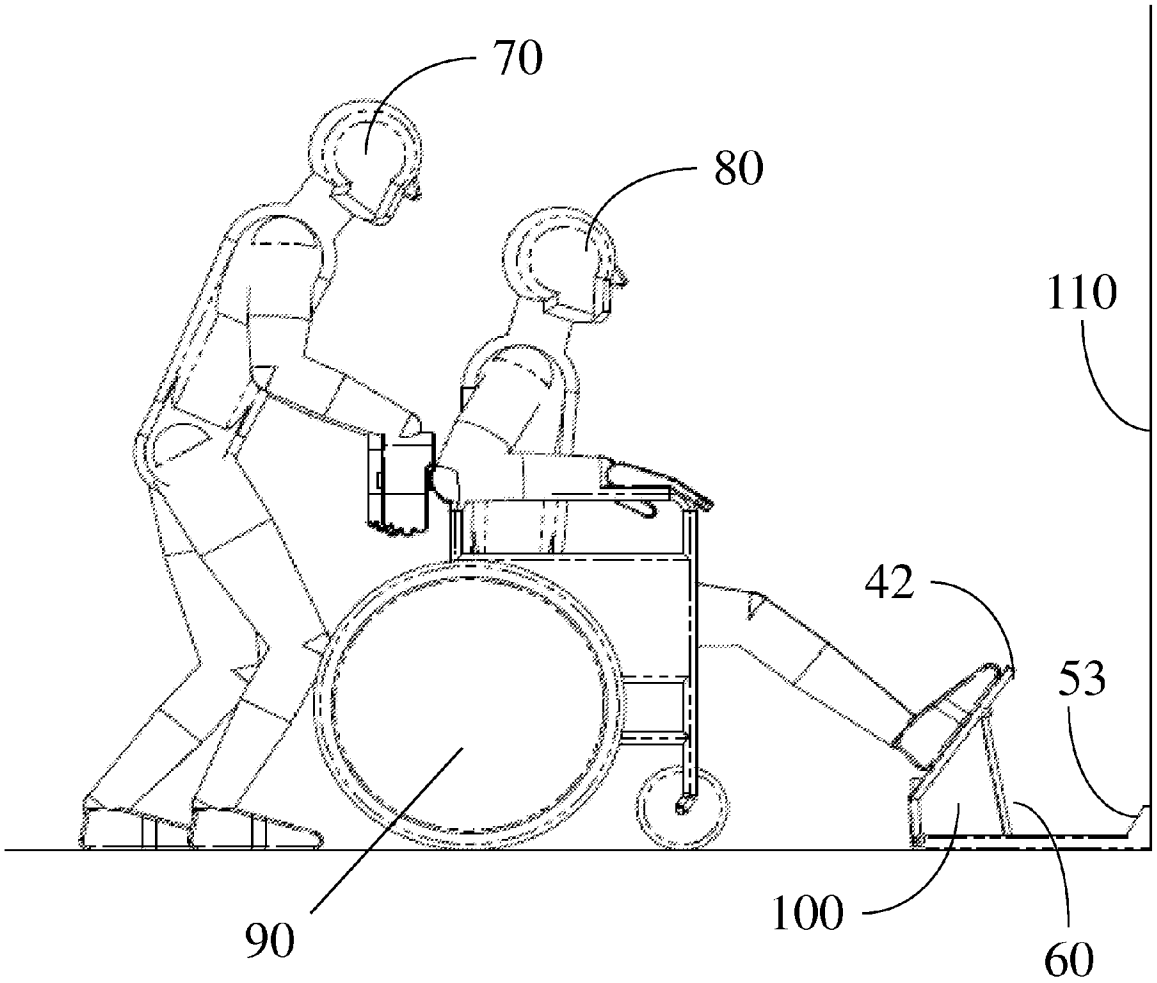
FIG. 6 is a side view illustrating a step in a method of conducting physical therapy using the leg exercise apparatus in the present invention.

When in use, the exercise apparatus 100 is placed on a floor with the end portion 53 against a wall surface 110 as shown in FIG. 6. The end portion 53 can be placed against any other suitable structure that will not move under the forces encountered, such as a door, desk or cabinet, or the exercise apparatus 100 can be removably mounted to the floor, such as by bolts or pins. A patient 80 sits in a wheelchair 90 with feet placed on the foot platform 42 of the exercise apparatus 100. A physical therapist 70 adjusts the angle of the foot platform 42 by moving the connecting panel 60 with the positioning bar 62 as described above.

Figure 7:
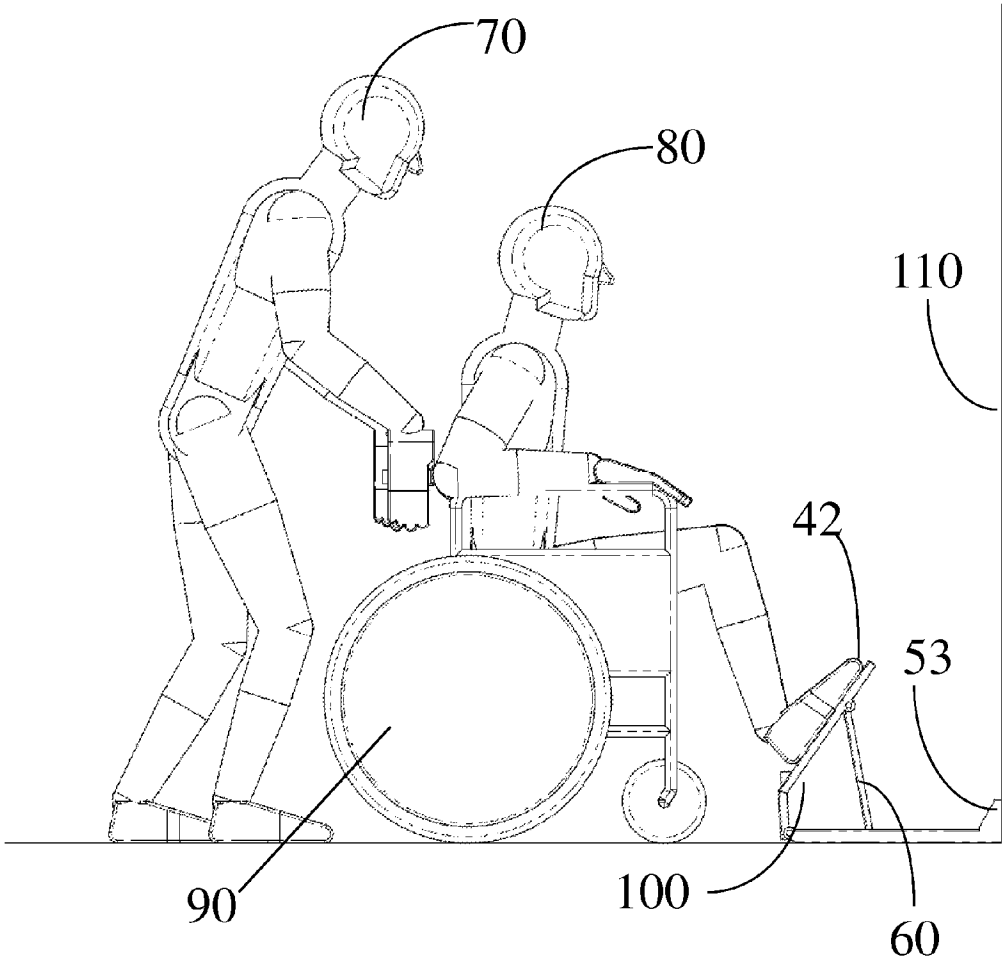
FIG. 7 is a side view illustrating another step in a method of conducting physical therapy using the leg exercise apparatus in the present invention.

Once the foot platform angle is set and the patient's feet are placed on the foot platform 42, the physical therapist 70 stands behind the wheelchair 90 and pushes the wheelchair 90 towards the wall surface 110. This pushing force is resisted by the patient's legs, which exercises the muscles of the lower extremity of the patient 80. More specifically, the physical therapist's action can flex the hip and knee joints and dorsiflexes the ankle joint, causing muscle loading through the closed chain foot, ankle, knee and hip structures. In a preferred embodiment, the therapist and patient work together to compress the patient's legs, as shown in FIG. 7, and then allow the patient to extend the same while the therapist resists. The therapist can tailor the force applied to the patient through the wheelchair and even tailor the force based upon the progress of a particular workout. Repetition of this movement increases muscle tone, joint passive range of motion, muscle group recruitment and venous blood flow.

The patient 80 thus actively exerts a counterforce against the physical therapist 70 to extend the hip and knee joints and plantarflex the ankle joint, which builds strength, muscle memory, muscle hypertrophy, endurance, sensation and circulation. Once the patient 80 extends the legs to the original position, the physical therapist 70 may exert the force again and repeatedly conduct the therapy process.

As previously discussed, the angle of the foot platform is at 55 degrees in a preferable embodiment. This angle provides an effective weight-bearing load through the calcaneus, talus, tibia, and fibula bones and corresponding joint structures to promote muscle strengthening. It also provides a comfortable ankle angle, considering possible joint range of motion limitations of geriatric patients, and does not put too severe of stress on the soft tissues of the limb during the phases of leg flexion in the exercise utilization of this invention. In other embodiments, the angle can be adjusted between about 45 and about 65 degrees by disposing the positioning bar 62 in different positioning grooves to accommodate a variety of joint flexibilities, leg length differences, and wheelchair heights in the patient population. Of course, it is contemplated that the angle can be as large or as small as is desired, and is not limited to 45 degrees at the low end or 65 degrees at the high end.

It is noted that the end portion 53 of the supporting frame 50 is disposed against the wall surface 110 as illustrated in FIG. 6. A lower portion of the end portion 53 may have an offset, and a contact area of the end portion 53 against the wall surface 110 can be reduced to avoid damage to the wall surface 110 when exerting force against it. Also, a plurality of pads 58 (see FIG. 4) are placed at a bottom surface of the base 56 to provide certain cushion effects and to avoid scratches on the floor.

Figure 8:
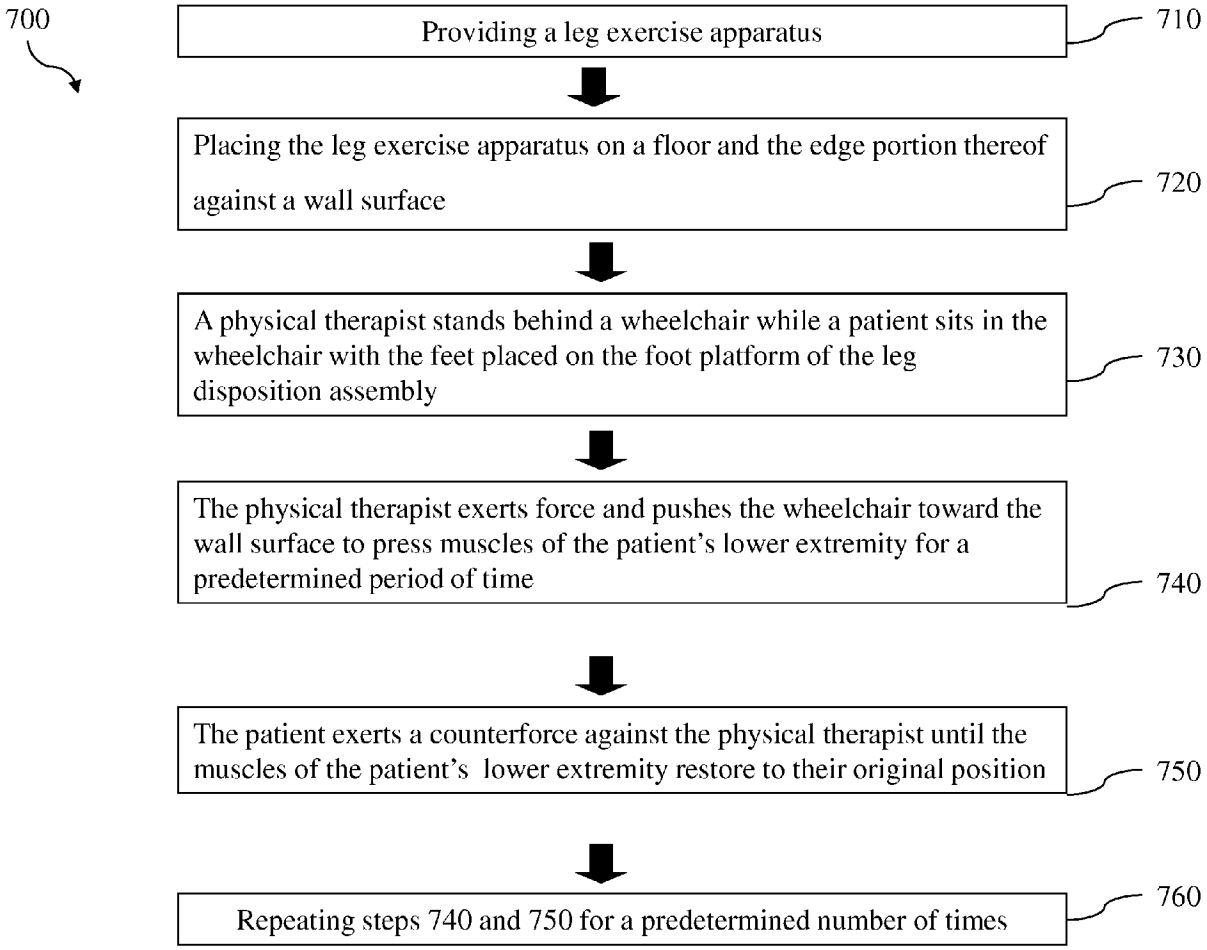
FIG. 8 is a flow chart illustrating steps of the method of conducting physical therapy.

According to another aspect shown in FIG. 8, the present invention provides a method (700) of conducting physical therapy comprising steps of: providing a leg exercise apparatus (described above) 710; placing the leg exercise apparatus on a floor and the end portion thereof against a wall surface 720; a physical therapist stands behind a wheelchair while a patient sits in the wheelchair with his or her feet placed on the foot platform of the leg disposition assembly 730; the physical therapist exerts a force to push the wheelchair towards the wall surface to press the muscles of the patient's lower extremity for a predetermined period of time 740; the patient exerts a counterforce against the physical therapist until the muscles of the patient's lower extremity restore to their original position 750; and repeating steps 740 and 750 for a predetermined number of times 760.

In one embodiment, the method of conducting physical therapy further comprises a step of: the therapist adjusting the angle of the foot platform 42 of the leg disposition assembly 40 by disposing the positioning bar 62 in different positioning grooves located at the inner surface of each first and second arms (51, 51'). In another embodiment, the method of conducting physical therapy further comprises a step of: the physical therapist cleaning the leg exercise apparatus 100 after use, and carrying it to the next patient. In a further embodiment, the method of conducting physical therapy further comprises a step of forming an offset at a lower portion of the end portion 53 to reduce a contact area between the end portion 53 and the wall surface 110 to avoid damage to the wall surface when exerting forces.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A leg exercise apparatus comprising:

a supporting frame having a receiving space defined by a base, an end portion plate, and first and second substantially parallel arms that extend from opposite sides of the end portion plate, wherein at least a first positioning groove is formed in an inner surface of the first arm and at least a second positioning groove is formed in an inner surface of the second arm;

a leg disposition assembly pivotably mounted to the supporting frame, wherein the leg disposition assembly has a foot platform and a heel rest;

a connecting panel pivotably mounted to the leg disposition assembly at one end and having a positioning bar extending from another end, and first and second tunnel grooves formed in an inner surface of the first and second arms adjacent the end portion plate and into which opposing ends of the positioning bar are configured to extend, the tunnel grooves opening into a gap formed between the end portion plate and the base that defines an end opening through which the positioning bar protrudingly extends to form a hand-grippable handle when the leg disposition assembly collapses into the receiving space;

wherein the positioning bar's opposing ends are configured to be disposed in the first and second positioning grooves to secure the connecting panel to the supporting frame and fix an angle of the foot platform relative to the supporting frame;

wherein a plurality of slots are formed on both sides of the foot platform, and a pair of hooks are located at the backside of the heel rest to engage with the slots to determine the heel rest's position on the foot platform.

2. The leg exercise apparatus of claim 1, further comprising a panel opening formed in the connecting panel for a user to extend a hand through the panel opening and grip a portion of the positioning bar to carry the leg exercise apparatus.

3. The leg exercise apparatus of claim 1, wherein the angle of the foot platform is adjusted by disposing the positioning bar in different positioning grooves located at the inner surface of the first and second arms.

4. The leg exercise apparatus of claim 3, wherein the foot platform is at an angle of about 55 degrees.

5. The leg exercise apparatus of claim 1, wherein a connecting portion extends from the leg disposition assembly to pivotably connect to the first and second arms of the supporting frame.

6. The leg exercise apparatus of claim 1, wherein the leg exercise apparatus is made of a material selected from metal, wood, and composite material.

7. A method of a physical therapist conducting physical therapy with a patient in a wheelchair, comprising the steps of:

(a) providing a leg exercise apparatus comprising:

(i) a supporting frame having a receiving space defined by a base, an end portion plate, and first and second substantially parallel arms that extend from opposite sides of the end portion plate, wherein at least a first positioning groove is formed in an inner surface of the first arm and at least a second positioning groove is formed in an inner surface of the second arm;

(ii) a leg disposition assembly that is pivotably connected to the supporting frame and has a foot platform and a heel rest at a front surface thereof;

(iii) a connecting panel pivotably connected to the leg disposition assembly at one end and having a positioning bar extending from another end, and (iv) first and second tunnel grooves formed in the inner surfaces of the first and second arms, respectively, adjacent the end portion plate, the tunnel grooves opening into a gap formed between the end portion plate and the base that defines an end opening;

(b) placing the leg exercise apparatus on a floor and the end portion plate thereof against a stable surface;

(c) disposing opposing ends of the positioning bar in the first and second positioning grooves to secure the connecting panel to the supporting frame and fix an angle of the foot platform relative to the supporting frame;

(d) the physical therapist exerting a force on the wheelchair while the patient sits in the wheelchair with the patient's feet placed on the foot platform of the leg disposition assembly, the force tending to push the wheelchair toward the wall surface and bend the patient's legs;

(e) the patient exerting a counterforce against the force using leg muscles tending to straighten the legs;

(f) repeating steps (d) and (e);

(g) sliding the opposing ends of the positioning bar through the tunnel grooves to collapse the leg disposition assembly into the receiving space and protrudingly extend the positioning bar through the end opening to form a hand-grippable handle; and (h) grasping the hand-grippable handle.

8. The method of conducting physical therapy of claim 7, further comprising the therapist adjusting a heel rest's position on the foot platform.

9. The method of conducting physical therapy of claim 7, further comprising:

(a) the physical therapist extending his hand through a panel opening formed near a center of the connecting panel;

(b) the physical therapist grasping the positioning bar; and (c) the physical therapist carrying the leg exercise apparatus.

10. The method of conducting physical therapy of claim 9, further comprising the physical therapist cleaning the leg exercise apparatus after use and carrying it to a next patient.

11. The method of conducting physical therapy of claim 7, further comprising the therapist adjusting the angle of the foot platform of the leg disposition assembly by disposing the positioning bar in third and fourth positioning grooves located at the inner surface of the first and second arms.

* * * * *